United States Patent [19]

Ekstran

[11] Patent Number: 4,932,707

[45] Date of Patent: Jun. 12, 1990

[54] LOCKING DEVICE FOR A DOOR OF A WASHING MACHINE, A SPIN DRYER OR THE LIKE

[75] Inventor: Lars A. Ekstran, Diö, Sweden

[73] Assignee: Aktiebolaget Electrolux, Stockholm, Sweden

[21] Appl. No.: 388,154

[22] Filed: Aug. 1, 1989

[30] Foreign Application Priority Data

Sep. 16, 1988 [SE] Sweden ..... 8803289

[51] Int. Cl.[5] ..... E05B 47/00

[52] U.S. Cl. ..... 292/341.17; 292/DIG. 69; 292/108; 292/254

[58] Field of Search ..... 292/254, 341.16, 341.17, 292/144, 108, DIG. 69, 201

[56] References Cited

U.S. PATENT DOCUMENTS 4,032,180 6/1977 Pohl ..... 292/DIG. 69 X
4,702,506 10/1987 Immura ..... 292/DIG. 4
4,776,620 10/1988 Marks et al. ..... 292/DIG. 69 X

*Primary Examiner*—Richard E. Moore

*Attorney, Agent, or Firm*—Pearne, Gordon, McCoy & Granger

[57] ABSTRACT

A locking device for a door of a washing machine, a spin dryer or the like comprises a locking plate (10*a*) disposed on the machine and having the opening (11). A catch member (12) disposed on the door is insertable in the opening. In its locking position the catch member engages with an edge (14) bounding the opening in order to keep the door closed. An electrically operable blocking means (19) is provided to prevent the catch member from moving from the locking position as long as a rotatable drum or the like in the machine is operating. A releasing means (22,24,25) is provided to release the blocking means (19) as soon as the rotational movement has ceased. An electrical drive means (22) is provided to move the blocking means (19) to a blocking position against the action of a biasing means (21) which strives to move the blocking means to a lock releasing position. The electrical drive means (22) co-operates with a mechanism (24) of a design such that upon activation of the drive means the blocking means is operated to alternatingly take the blocking position and the lock releasing position, respectively.

6 Claims, 2 Drawing Sheets

LOCKING DEVICE FOR A DOOR OF A WASHISNG MACHINE, A SPIN DRYER OR THE LIKE

Figure 1:
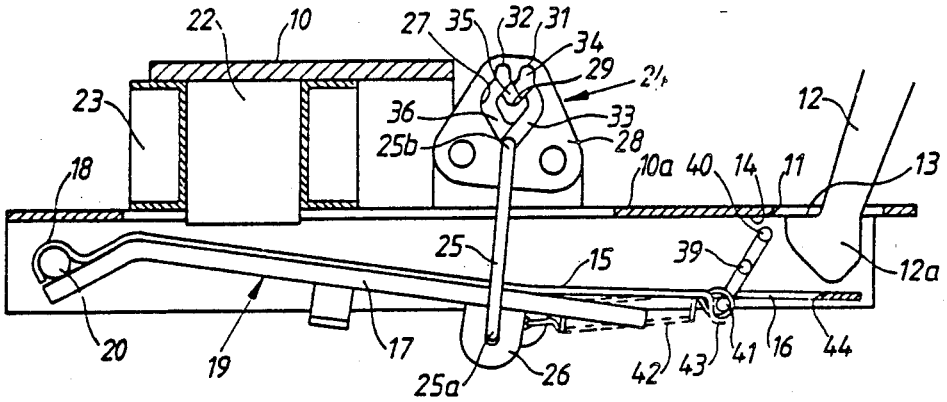

The present invention refers to a locking device in a door of a washing machine, a spin dryer or the like according to the preamble of the following claim 1.

In industrial washing machines multispeed motors provided with a free wheel mechanism are being used. In stopping the washing drum of such a machine the motor is switched off, however, no braking takes place. In a large machine, for example taking 80 kg of laundry, it may take up to five minutes before the drum has come to a complete stop.

The purpose of the locking device is to prevent opening of the door until the drum has stopped. In this connection there is a desire for the possibility of opening the door even in case of power failure. This wish can be met with by using a bimetal lock wherein a bimetal operated catch member is kept in a blocking position by an electric current heating the bimetal. In case of power failure the heating current will cease and the catch member will move from the blocking position to a lock releasing position. However, bimetal locks are sensitive to temperature which cause a great variation in the time of change from the blocking to the releasing position.

The time to lapse before the door of the machine can be opened has to be chosen so long that in any case the drum has stopped before opening can take place. The drum stopping time varies with the amount of laundry and also depends on whether the machine is new or old (the drum rotates more easily in an old machine).

When using a bimetal lock in a machine of the kind referred to the variation in the change-over time has to be combined with varying drum stopping times which very easily causes unacceptably long waiting times before the door can be opened. One solution of the problem is the use of a rotational movement sensor which upon stopping of the drum operates a control device which releases the door lock. Such solutions are described in the patent publications DE-A-2,163,449 and DE-A-2,318,363. In a further known washing machine in which the lock releasing process is controlled by a rotational movement sensor a catch member of the lock is operated to take its blocking and lock releasing positions, respectively, by two separate electromagnets. This means that even if the catch member can be activated to block the lock a fault may occur on the other electromagnet causing a situation where the lock cannot be released and, accordingly, the door cannot be opened. In connection with so-called coinoperated operated washing machines in self-service shops such a situation may result in locks being broken as the customers cannot get their laundry out. For the same reason the door lock must be releasable in case of power failure. This will not take place automatically in case of locks controlled by a rotational movement sensor as when the lock is operated by a bimetal.

In the light of the prior art technique described above it is an object of the invention to provide a locking device having an electrically operable catch member of a design such that the same operating means be active both when the catch member is to be moved to the blocking position and when it is to be moved to the releasing position. In this way the catch member taking its blocking position will serve as a receipt of the fact that the operating means is functioning and, accordingly, with great probability the operating means will function also during the course of the lock opening to follow.

Another object is to simplify the known device having two separate operating means and hence to reduce the costs of manufacture.

The two objects indicated have been achieved in a locking device having the characterizing features indicated in claim 1. Preferred embodiments appear from the appending sub-claims.

The invention will now be described more in detail in connection with an embodiment with reference to the enclosed drawings.

FIGS. 1–4 schematically show a door lock according to the invention

The figures are side views, partly in section, showing the lock in different positions of operation.

Figure 5:
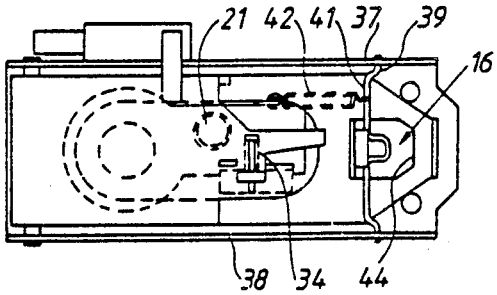

FIG. 5 shows the door lock of FIGS. 1-4 in a bottom view.

The door lock is built up on a base 10 which by means not shown in secured adjacent to the loading opening of a washing machine, not shown. The base is provided with a locking plate 10*a* having an opening 11 through which a catch 12 can be inserted. The catch is pivotably journaled on a door, not shown, closing the loading opening. Moreover, by spring means the catch is biased to the position shown in FIG. 2 where an edge 13 on the catch falls in behind an edge 14 bounding the opening 11. By maneuvering of an operating member on the door, not shown, the catch can be turned against the action of the spring means to the position shown in FIG. 1 in order for the door to be opened.

Figure 2:
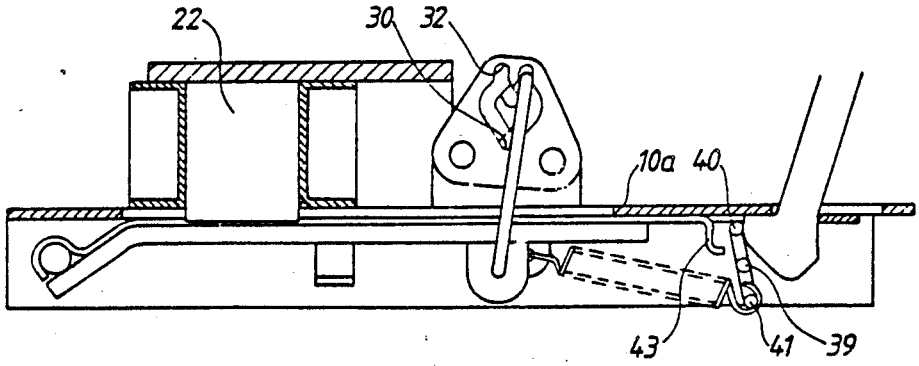

When the washing machine is operating it shall not be possible to open the door. For this purpose a blocking plate 15 is provided with an opening 16 which, as shown in FIG. 2, surrounds a part 12*a* of the catch 12 inserted through the opening 11. An edge 44 bounding the opening 16 of the blocking plate bears on the part 12*a* of the catch 12 preventing it from moving away from the locking position. Along part of its length the blocking plate 15 is fixedly secured to a plate 17 acting as a support for plate 15. The two plates are so interconnected that the blocking plate is given the shape of a V the legs of which are directed towards the locking plate 10a. The opposite end of theblocking plate formshe with the plate 17 a journalling sleeve 18 by which the journalled on a pin 20 fixed to the base 10. By a spring 21, FIG. 5, the unit 19 is biased to the position shown in FIG. 3, which is the lock releasing position of the blocking plate.

For operating the unit 19 and hence the blocking plate 15 an electromagnet 22 is provided which has an excitation winding 23 connected to a control device, not shown. In a manner not described in detail the control device co-operates with a programmer provided for the control of the washing machine. The electromagnet 22 is acting as a pulling magnet attracting when activated the unit 19 which forms the movable armature of the magnet. FIG. 2 shows this condition which appears when the catch 12 is to be blocked and when it is to be released as well. The electromagnetic co-operates with a separate mechanism 24 in order to keep the blocking plate in the blocking position (FIG. 3) and in the lock releasing position (FIG. 1), respectively. The mechanism comprises a wire bow 25 which is turnably journalled by a part 25*a* entering a journalling hole in a sheet metal bracket 26. The opposite end 25*b* of the wire bow co-operates with a guiding track 27 provided in a guide plate 28. The guiding track comprises two rest positions 29, 30 corresponding to the blocking position, FIG. 3, of the blocking plate 15 and to the lock-releasing position, FIG. 1, thereof (see also FIG. 2). The guiding track also comprises two temporary rest positions 31, 32 which are disposed between the rest positions 29, 30. With the opposite end **25*b* taking any of the said temporary rest positions 31, 32 the unit 19 is permitted to move to a position wherein the blocking plate 15 bears on the locking plate 10*a***.

The guiding track extends inwards into the plane of the paper and has a bottom part provided with steps 33, 34, 35, 36 of a design placing the different rest positions in different planes in the depth direction of the track. The end **25*b* of the wire bow extends perpendicular to the plane of the paper towards the bottom of the track against which it is biased by a spring 45**.

Figure 3:
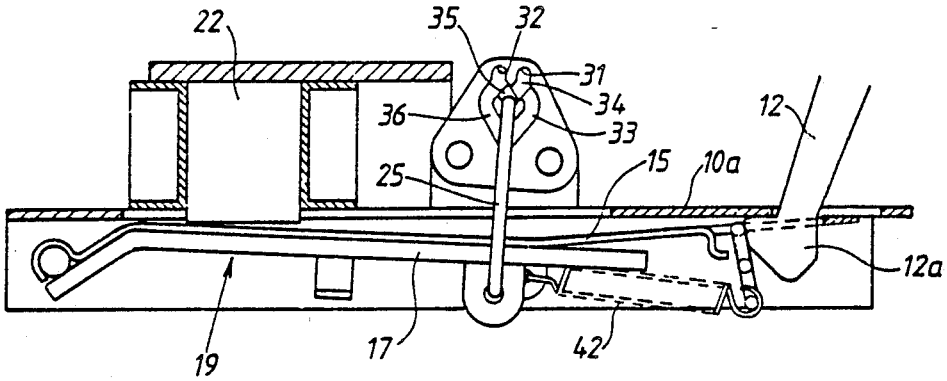
Figure 4:
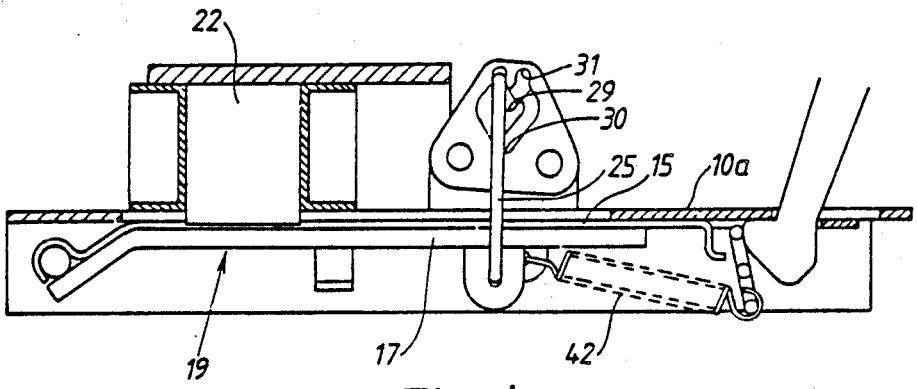

As appears from FIG. 3, when the wire bow 25 has taken the rest position 29 the plate 17 has taken a position between the position shown in FIG. 2 and the position shown in FIG. 1. However, due to the V-shape of the blocking plate the end of the blocking plate having the opening 16 will still in this position engage with the catch 12 to block it. The blocking plate is made of resilient material permitting movement of the unit 19 to the position shown in FIGS. 2 and 4.

The steps 33, 34, 35, 36 are situated in different planes such that in the order indicated each step at the border to the following step is disposed at a higher level than said following step. Accordingly, when the magnet 22 is activated and the wire bow is in the rest position 30 the wire bow will be moved along the steps 33 and 34 to the temporary rest position 31. Then, when the magnet is inactivated the wire bow is moved via steps 34 and 35 to the rest position 29 where it remains. This course is shown in FIGS. 2 and 3 where FIG. 2 shows the positions of the wire bow and the unit 19, respectively, when, starting from the position shown in FIG. 1 with a catch taking its locking position (FIG. 2), the magnet 22 has been activated. In FIG. 3 there are shown the positions of the wire bow and the unit 19 with the blocking plate 15, respectively, when the magnet has been inactivated. Here, the blocking plate has taken its blocking position. Next time the magnet 22 is activated the wire bow 25 is moved via the steps 35, 36 to the temporary rest position 32 and upon the following inactivation of the magnet the wire bow will be guided via steps 36, 33 back to the rest position 30 causing the unit 19 to take the position shown in FIG. 1 and the blocking plate to take its locking releasing position.

In case the catch 12 has not taken its locking position, FIG. 2, it shall not be possible to move the blocking plate 15 to its blocking position. For this purpose a blocking device is provided in the shape of a wire bow 39 journalled in two side parts 37, 38 of the base 10. The wire bow 39 has two parts 40, 41 which are oppositely disposed with respect to the journalling axis. The part 41 is biased in a clockwise direction by a spring 42, see FIGS. 1–4. When the catch 12 is absent the wire bow 39 is turned to the position shown in FIG. 1 where the part 41 falls into the way of movement of an abutment 43 disposed on the blocking plate 15. When the magnet 22 is activated the wire bow 39 will be clamped between the abutment 43 and the locking plate 10a blocking the further movement of unit 19. When the catch is moved to the position shown in FIG. 2 the part **12*a* acts on the part 40 of the wire bow 39 causing the part 41 to be moved out of the way of movement of the abutment 43**.

I claim:

1. A locking device for a door of a washing machine, a spin dryer or the like, comprising a locking plate (**10*a*) disposed on the machine and having an opening (11), and a catch match (12) disposed on the door to be insertable in the opening, the catch member in a locking position engaging with an edge (14) bounding the opening to keep the door closed, an electrically operable blocking means (19) being provided to prevent the catch member from moving from the locking position as long as a rotatable drum or the like in the machine is operating, releasing means (22,24,25) being provided to release the blocking means (19) as soon as the rotational movement has ceased, characterized in that an electrical drive means (22) is provided for moving the blocking means (19) to a blocking position against the action of a biasing means (21) which strives to move the blocking means to a lock releasing position, the electrical drive means co-operating with a mechanism (24**) of a design such that upon activation of the drive means the blocking means is operated to alternatingly taken the blocking position and the lock releasing position, respectively.

2. A locking device according to claim 1, characterized in that the drive means (22) is an electromagnet, the movable armature of which is constituted by the blocking means (19) which has a part (15) provided with an opening (16), said part in the blocking position of the blocking means surrounding the catch member (12), wherein an edge (44) bounding the opening operates to block the catch member in its locking position.

3. A locking device according to claim 2, characterized in that the blocking means (19) comprises a pivotably journalled plate (17) which when the electromagnet (22) is activated takes a position in which it extends mainly parallel to the locking plate (**10*a*), the part of the blocking means incorporating the opening (16) being formed by a blocking plate (15) made of a resilient material and being secured to the pivotable plate (17) in such a way that in the blocking position of the blocking means the blocking plate has the shape of a V the legs of which are facing the locking plate (10*a***).

4. A locking device according to claim 3, characterized in that the mechanism (24) co-operating with the drive means (22) comprises a wire bow (25) or the like movably secured to the pivotable plate (17) and having one end (**25*b*) which co-operates with a guiding track (27) having two rest positions (29,30) corresponding to the blocking position and the lock releasing position, respectively, of the blocking means, and two temporary rest positions (31,32) disposed between the said rest positions (29,30), the wire bow (25) alternatingly taking one (31) or the other (32) of the temporary rest positions when with the electromagnet (22) being activated the pivotable plate (17) of the blocking means in compressing the blocking plate (15) takes the position in which it extends parallel to the locking plate (10*a***).

5. A locking device according to any one of the preceding claims characterized in that a blocking device (39,40,41;43) is provided to prevent the blocking means (19) from moving to the blocking position in case the catch member (12) has not taken the locking position.

6. A locking device according to claim 5, characterized in that the blocking device comprises a wire bow (39) pivotably journalled in the machine and having two parts (40,41) disposed at both sides of the journalling axis and forming levers, one (40) of said parts co-operating with the catch member (12) and the other part (41) co-operating with an abutment (43) provided on the blocking means (19), said blocking device (39,40,41) in its blocking position cooperating with the abutment (43) to prevent the blocking means from moving to its blocking position while the catch member (12) when taking its locking position engages with the wire bow (39) to turn it to a position in which said movement of the blocking means (19) is permitted.

* * * * *

UNITED STATES PATENT AND TRADEMARK OFFICE

CERTIFICATE OF CORRECTION

PATENT NO. : 4,932,707

DATED : June 12, 1990

INVENTOR(S) : Lars A. Ekstran

It is certified that error appears in the above-identified patent and that said Letters Patent is hereby corrected as shown below:

Column 2, line 46, delete "theblocking" and insert --the blocking--; and delete "formshe" and insert --forms--.

Column 2, line 47, after "the" (second occurrence) insert --unit 19 formed by the blocking plate 15 and the support plate 17 is pivotaly--.

Column 3, line 52, delete "locking" and insert --lock--.

Column 4, line 7, delete "match" and insert --member--.

Signed and Sealed this

Second Day of July, 1991

*Attest:*

*Attesting Officer*

HARRY F. MANBECK, JR.

*Commissioner of Patents and Trademarks*